US005391831A

United States Patent [19]

Lace

[11] Patent Number: 5,391,831

[45] Date of Patent: Feb. 21, 1995

[54] ELECTROMAGNETIC MUSICAL PICKUP HAVING U-SHAPED FERRMAGNETIC CORE

[75] Inventor: Melvin A. Lace, Prospect Heights, Ill.

[73] Assignee: Thomas E. Dorn, Clarendon Hills, Ill. ; a part interest

[21] Appl. No.: 294

[22] Filed: Jan. 4, 1993

Related U.S. Application Data

[63] Continuation-in-part of Ser. No. 764,346, Sep. 23, 1991, abandoned, and Ser. No. 900,485, Jun. 18, 1992, said Ser. No. 764,346, said Ser. No. 900,485, is a continuation-in-part of Ser. No. 597,899, Oct. 10, 1990, abandoned.

[51] Int. Cl.[6] ..... G10H 3/18

[52] U.S. Cl. ..... 84/726

[58] Field of Search ..... 84/723, 725, 729, 743

[56] References Cited

U.S. PATENT DOCUMENTS

| | | |
|---|---|---|
| 2,089,171 | 8/1937 | Beauchamp . |
| 2,896,491 | 7/1959 | Lover . |
| 3,066,567 | 12/1962 | Kelley . |
| 3,183,296 | 5/1965 | Meissner . |
| 3,236,930 | 2/1966 | Fender . |
| 3,571,483 | 3/1971 | Davidson . |
| 3,588,311 | 6/1971 | Zoller . |
| 3,902,394 | 8/1974 | Stich . |
| 3,916,751 | 11/1975 | Stich . |
| 3,983,778 | 10/1976 | Bartolini . |
| 4,026,178 | 5/1977 | Fuller . |
| 4,133,243 | 1/1979 | DiMarzio . |
| 4,145,944 | 3/1979 | Helpinstill . |
| 4,220,069 | 9/1980 | Fender . |
| 4,268,771 | 5/1981 | Lace . |
| 4,320,681 | 3/1982 | Altilio . |
| 4,442,749 | 4/1984 | Dimarzio et al. . |
| 4,501,185 | 2/1985 | Blucher . |
| 4,809,578 | 3/1989 | Lace, Jr. . |
| 4,852,444 | 8/1989 | Hoover et al. . |
| 4,878,412 | 11/1989 | Resnik . |
| 5,072,646 | 12/1991 | Valkama . |
| 5,221,805 | 6/1993 | Lace ..... 84/726 |

*Primary Examiner*—William M. Shoop, Jr.
*Assistant Examiner*—Jeffrey W. Donels
*Attorney, Agent, or Firm*—Dorn, McEachran, Jambor & Keating

[57] ABSTRACT

An electromagnetic pickup for a musical instrument, such as a guitar, strung with ferromagnetic strings, comprises an elongated ferromagnetic (steel) core of U-shaped or double U-shaped transverse cross-section. An electrical pickup coil in a non-magnetic coil form encompasses one core leg; transversely magnetized main permanent magnets engage the top edges of the core legs. The magnets, which may be integral with each other, are preferably formed of a resin impregnated with magnetic particles; they maintain adjacent core legs at opposed polarities. The main magnets may be mounted in or on the top of a housing that encloses the core and the coil; the housing provides for mounting the pickup in spaced relation below the strings so that the pickup produces a magnetic field that encompasses the strings and string movement generates electrical signals in the coil. There may be additional permanent magnets to shield the coil. Dual-coil humbucker embodiments of the pickup are described. Frequency response, "sustain", signal-to-noise, and amplitude characteristics of the pickup are varied by selection of thickness and material of core members, by the shield magnets, by the size of wire used in the coil, and by the compositions and magnetization patterns of the main permanent magnets.

26 Claims, 5 Drawing Sheets

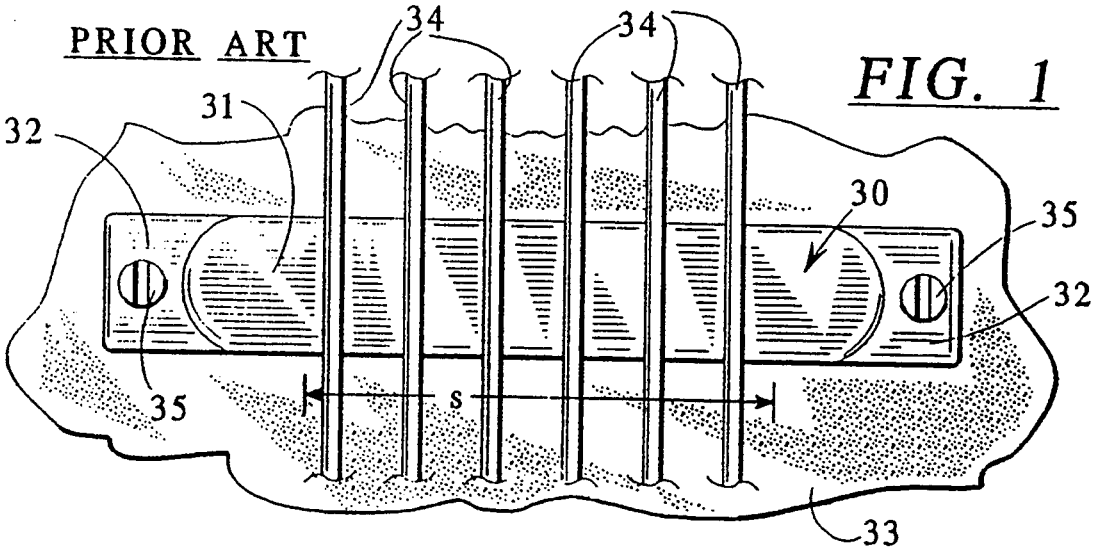
FIG. 1
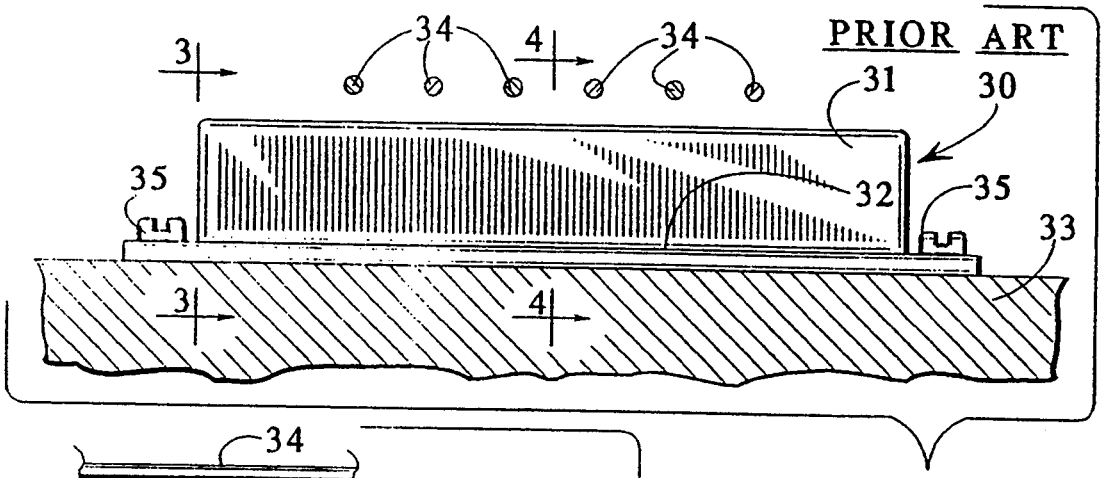
FIG. 2
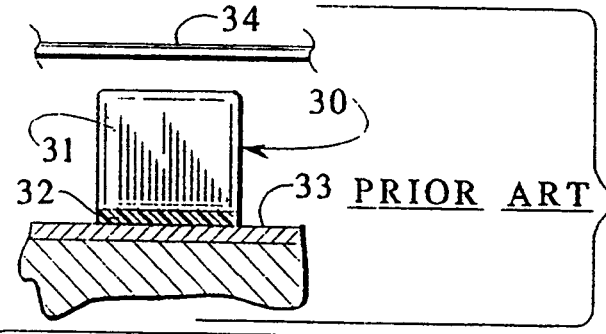
FIG. 3
FIG. 17
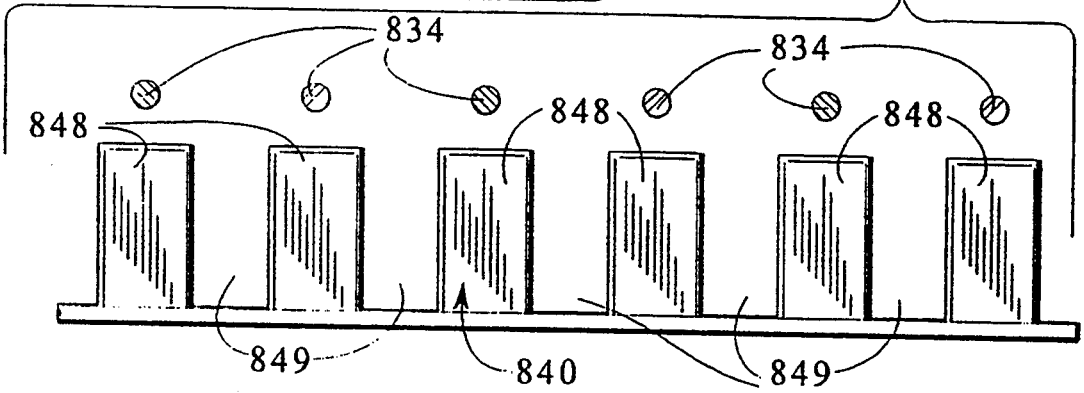

FIG. 4
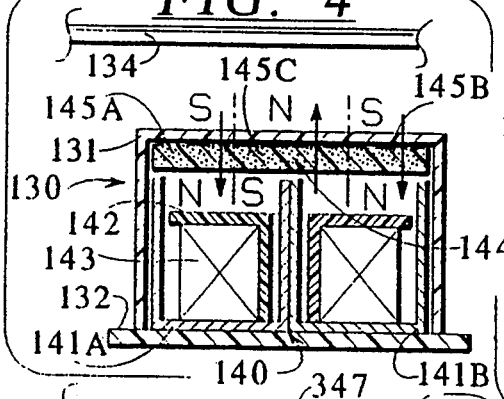
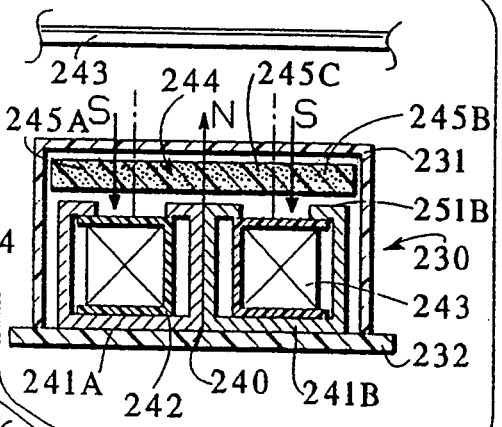
FIG. 7
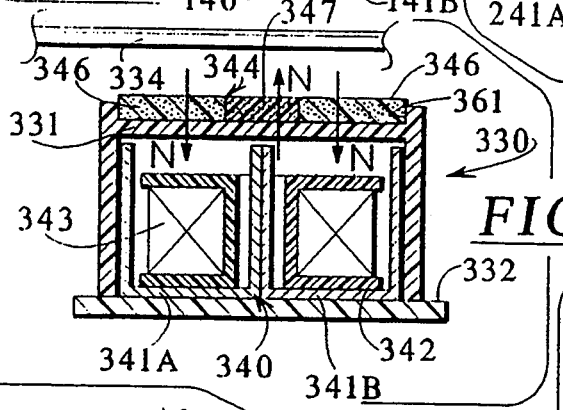
FIG. 8
FIG. 9
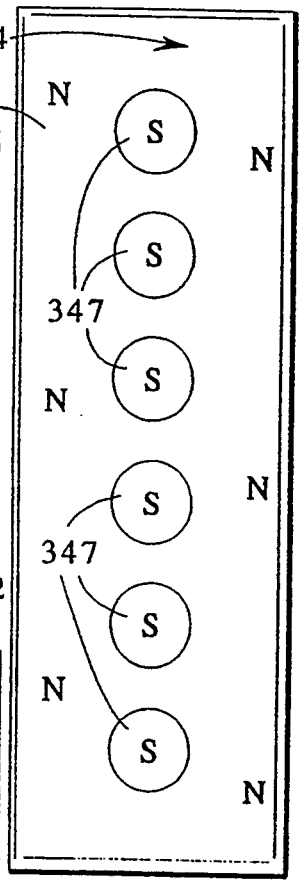
(BOTTOM)
FIG. 5
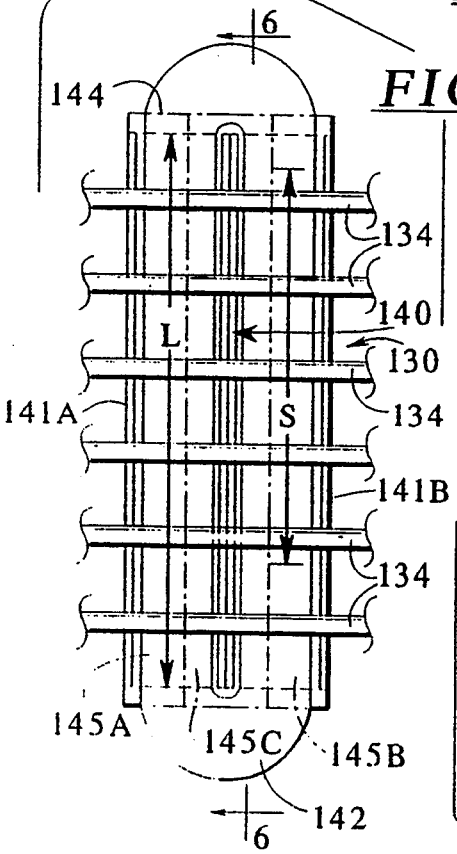
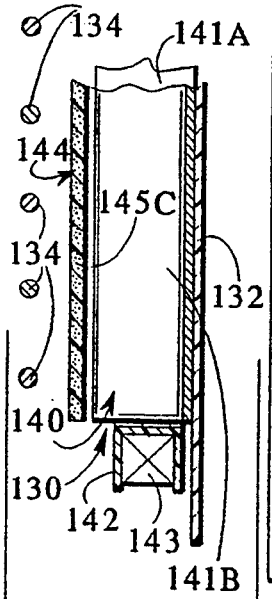
FIG. 6

ELECTROMAGNETIC MUSICAL PICKUP HAVING U-SHAPED FERRMAGNETIC CORE

This application is a continuation-in-part of prior applications Ser. No. 07/764,346, filed Sep. 23, 1991 and Ser. No. 07/900,485, filed Jun. 18, 1992, which are continuations-in-part of Ser. No. 07/597,899, filed Oct. 10, 1990. Applications Ser. Nos. 07/764,346 and 07/597,899 have been abandoned.

BACKGROUND OF THE INVENTION

For many years, electromagnetic signal pickups have been utilized on musical instruments having ferromagnetic strings. Such pickups have been employed with guitars, bass guitars, banjos, mandolins, and a variety of other instruments. A pickup for a musical instrument that uses ferromagnetic strings almost invariably incorporates a magnetic structure for generating a magnetic field that encompasses the strings. That magnetic structure usually includes at least one permanent magnet and at least one high-permeability pole piece. Frequently, the pickup has a separate pole piece or permanent magnet for each string; thus, a guitar pickup may have six pole pieces or six permanent magnets, one for each string. On the other hand, some electromagnetic pickups have a single pole piece that spans a number of strings, often all of the strings of the instrument.

The pickup may have an electrical pickup coil for each string, or it may have one electrical pickup coil, spanning the poles for some or all strings, that generates a composite plural-string signal. The electrical signals from the coil or coils are amplified and reproduced by a speaker or other transducer as the output of the musical instrument. The electrical pickup coils are customarily disposed in encompassing relation to the magnetic cores; when there are plural coils each coil usually has its own core. This relatively simple electromagnetic structure is fitted into a housing. The housing may or may not be part of the magnetic structure. Whether or not it is a part of the magnetic structure, a principal purpose of the housing is to protect the pickup from dirt and other contaminants.

A wide variety of individual constructions have been used for electromagnetic pickups employed with musical instruments such as guitars. Frequently, the efforts of the pickup designer have been directed toward achieving an output signal from the electrical coil that is as close as possible to a faithful reproduction of the sound that would be developed by the instrument functioning as an acoustical device. This is not always the case, however; many electromagnetic pickups have been designed to give a particular distortion deemed desirable by the designer or by a musician.

For electromagnetic pickups in general, as applied to musical instruments having steel or other ferromagnetic strings, there may be some difficulty in obtaining an output signal of sufficient amplitude. This may be a minor problem, with modern electronic technology, because even a very weak signal can often be amplified to an adequate amplitude. On the other hand, a reasonable output amplitude from the pickup itself is desirable because it reduces the necessity for subsequent amplification, and thus reduces the likelihood of inadequately controlled distortion. Moreover, with adequate initial amplitude of the signal generated by the pickup, the signal-to-noise ratio is increased so that a "purer" signal can be realized.

A pronounced problem, in many electromagnetic pickups for musical instruments, has to do with the frequency response. The overall "sound" derived from the output signal is usually critical to the requirements of the musician. Some musicians want to have the output signal as close as possible to the acoustic output of the instrument, at least in theory. Others, however, want to have a distortion that is acceptable to them, one that represents their own concept or technique for interpretation of music. The frequency response characteristics of the pickup are critical in this regard. A similar situation is presented by the sound characteristic known to musicians as "sustain"; sometimes accented "sustain" is desirable in the view of the musician using the pickup and sometimes it is not.

SUMMARY OF THE INVENTION

It is a primary object of the invention, therefore, to provide a new and improved electromagnetic pickup, for a musical instrument having a plurality of ferromagnetic strings, which affords improved initial amplitude and signal-to-noise ratio, and that can generate signals having a broad range of different frequency and "sustain" characteristics.

A specific object of the invention is to provide a new and improved electromagnetic pickup for a plural ferromagnetic stringed musical instrument that affords a high amplitude output signal, despite substantial variations in the construction and operation of the pickup itself, and that can produce a variety of different frequency effects in its output signal.

Another object of the invention is to provide a new and improved electromagnetic pickup for a plural ferromagnetic stringed instrument, particularly a guitar, that is simple and inexpensive in construction, that can be readily mounted upon the guitar, and that has a virtually indefinite life.

Accordingly, the invention relates to an electromagnetic pickup for a musical instrument, such as a guitar, having a plurality of ferromagnetic strings disposed in generally co-planar spaced relation to each other and extending parallel to each other in a given plane over a predetermined span S, the pickup being adapted to be mounted adjacent the strings in spaced relation thereto. The pickup comprises an elongated ferromagnetic core, having a length L larger than S and a substantially smaller height, the core extending transversely to the direction of the strings. The core has a U-shaped configuration; it includes a base interconnecting first and second legs projecting in the same direction from the base. An electrical pickup coil is disposed in encompassing relation to the first leg of the core. The pickup further comprises main permanent magnet means including first and second elongated permanent magnets; the first permanent magnet is aligned with an edge of the first leg of the core and the second permanent magnet is aligned with an edge of the second leg of the core. The first and second permanent magnets are each transversely magnetized to present a permanent magnet pole facing the associated leg of the core, the first and second permanent magnets being polarized oppositely from each other. The pickup includes mounting means for mounting the core and the permanent magnet means on the musical instrument with the legs of the core projecting toward but spaced from the strings.

BRIEF DESCRIPTION OF THE DRAWINGS

FIG. 1 is a plan view of an electromagnetic musical pickup, specifically a guitar pickup, of the kind to which the invention is directed;

FIG. 2 is a side elevation view of the pickup apparatus of FIG. 1;

FIG. 3 is a section view taken approximately along line 3—3 in FIG. 2;

FIG. 4 is a transverse sectional view, taken approximately as indicated by line 4—4 in FIG. 2, illustrating a guitar pickup construction in accordance with one embodiment of the invention;

FIG. 5 is a plan view of the pickup of FIG. 4 with the outer housing and permanent magnet omitted;

FIG. 6 is a partial longitudinal sectional view taken approximately along line 6—6 in FIG. 5;

FIGS. 7 and 8 are transverse sectional views, like FIG. 4, of other embodiments of the invention;

FIG. 9 is a bottom view of a permanent magnet for the pickup of FIG. 8, also usable in other embodiments;

FIG. 17 is an elevation view of one form of ferromagnetic core usable in the invention.

DESCRIPTION OF THE PREFERRED EMBODIMENTS

Figure 10:
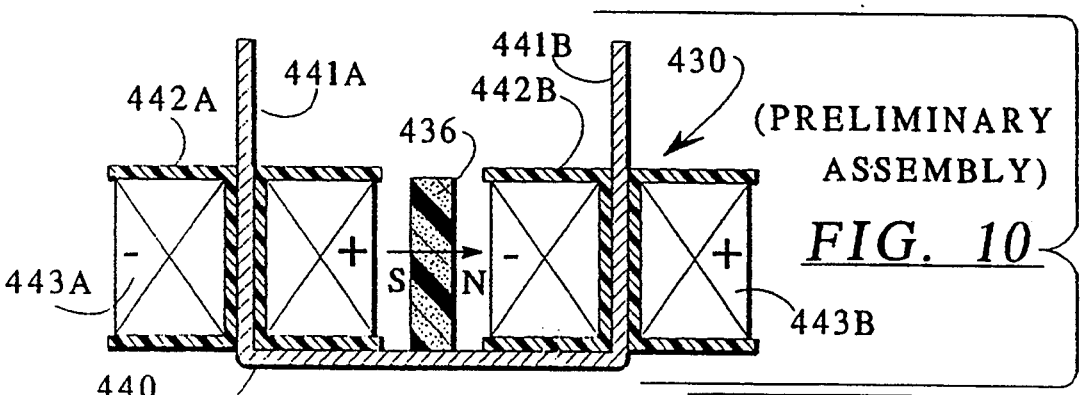
FIG. 10 is a transverse sectional view of an early stage in assembly of a dual coil embodiment of the invention.

FIGS. 1–3 illustrate an electromagnetic guitar pickup 30 that may be deemed generally representative of prior art pickups but that also applies to the electromagnetic musical pickups of the present invention. Typically, pickup 30 comprises a housing 31 that includes a base plate 32. Housing 31 may be formed entirely or partly of steel or other magnetic material if it is used as an operating component of pickup 30; the housing may be of plastic if it is not a working magnetic component of the pickup. Pickup 30 is mounted on the top 33 of a musical instrument having a plurality of ferromagnetic strings 34. As illustrated, strings 34 are the six strings of a tenor guitar and extend across but in spaced relation to the top surface 33 of the guitar neck or body, depending upon where the pickup 30 is mounted. Strings 34 are distributed across a span S, FIG. 1, usually with approximately equal spacing between strings. Appropriate mounting devices 35 are utilized to mount pickup 30 on guitar body 33.

A wide variety of different electromagnetic sensing devices have been utilized in prior art embodiments of pickup 30; consequently, no specific pickup operating structure is shown in FIGS. 1–3. On the other hand, it may be noted that any known construction for electromagnetic pickup 30 would include a magnetic structure for generating a magnetic field that encompasses in part, the ferromagnetic strings 34. A structure of this sort, in any of the known prior art devices, customarily includes at least one permanent magnet and may include at least one high permeability ferromagnetic pole piece. For the electromagnetic pickup 30 shown in FIGS. 1–3, utilizing known constructions, there could be six pole pieces, or six magnets, one for each string 34. On the other hand, some forms of electromagnetic pickup have utilized a single pole piece that extends the length of the pickup, beneath all of the musical strings 34.

In any of the known forms of electromagnetic pickup there is at least one electrical pickup coil, not shown in FIGS. 1–3; there may be separate coils for each of the strings 34, usually with all of those coils electrically connected together. The entire pickup construction, including the pole piece or pieces, the permanent magnet or magnets, and the electrical pickup coil or coils, is disposed in housing 31. Vibrations of the musical instrument strings 34, both vertically and horizontally, generate electrical signals in the coil or coils within housing 31, and it is those signals that are amplified and reproduced, as by one or more speakers, to afford an output from the musical instrument in conventional manner.

FIGS. 4–6 illustrate the operating components of an electromagnetic musical pickup 130 constructed in accordance with one embodiment of the present invention. Pickup 130 has a housing 131 with a base 132, best shown in FIG. 4, and includes an elongated combination ferromagnetic shell and core 140 that extends for a length L that is larger than the string span S (FIG. 5). Thus, the combination shell and core 140 spans all of the ferromagnetic strings 134 of the musical instrument. In this instance, it is assumed that pickup 130 is used for a six string guitar. In the embodiment of FIGS. 4–6, the core/shell 140 is formed by two sheet steel members 141A and 141B, each of U-shaped cross-sectional configuration with a base interconnecting a first core leg to a second leg that serves as an outer shield. A non-magnetic coil form 142 is mounted on and encompasses the first central vertical core legs of these two steel core/shell members 141A and 141B. An electrical pickup coil 143 is mounted in coil form 142, and thus is disposed in encompassing relation to the first legs of both halves of core/shell 140. Pickup coil 143 generates an electrical signal representative of movements of the strings 134 of the instrument.

An elongated rectangular permanent magnet 144 is mounted in housing 131 above the two U-shaped core and shell members 141A and 141B. Permanent magnet 144, shown in phantom outline in FIG. 5, covers all of the operating components of pickup 130 except the extreme outer ends of coil 143 and coil form 142; see FIG. 6. The magnet could cover these, too, but this is not necessary. Permanent magnet 144 is shown spaced by a small gap from the edges of the legs of core/shell 140, but could equally well be in direct contact with them.

Permanent magnet 144 is transversely magnetized in three longitudinal sections 145A, 145B, and 145C. Sections 145A and 145B, aligned over the outer vertical (shell) legs of core/shell members 141A and 141B, respectively, are both transversely magnetized to present continuous, uniform north poles facing these legs. Center section 145C, however, is magnetized in the opposite direction, presenting a continuous uniform south pole to the vertical center (core) legs of members 141A and 141B. These polarities can be reversed, as by rotating permanent magnet 180° about a central longitudinal axis, without changing the overall operation of pickup 130.

The preferred permanent magnet material for magnet 144 preferably comprises a resin matrix of permanent magnet particles; a relatively flexible and slightly elastomeric resin that is impregnated with particulate permanent magnet material is preferred. Such permanent magnet resin materials are readily available commercially, especially in rather thin sheets. One acceptable form of flexible permanent magnet resin material for magnet 144 is made and sold by 3M Company under the trademark PLASTIFORM; another flexible resin permanent magnet material that may be utilized in device 130 for the permanent magnet 144 is made and sold by B. F. Goodrich Company under the trademark KOROSEAL. Yet another such material is available from The Electrodyne Company of Batavia, Ohio, under the designation PLASTALLOY for a permanet material, like those just identified, that has a moderate induction level; similar material with a higher induction level (maximum energy product) is sold by Electrodyne under the designation REANCE 90. The preferred wire size for coil 143 is 42 gauge or 43 gauge copper wire. That wire size is larger than conventional, and affords a better high frequency response. For core/shell 140, No. 1008 steel is suitable; other ferrogmagnetic steels can be used. A thickness of about 0.02–0.04 inch (0.05–0.1 cm) is satisfactory; with thicker steels in shell/core 140, pickup 130 affords an increased bass response.

The electromechanical musical pickup 130 of FIGS. 4–6, even when constructed with a low-energy permanent magnet 144, produces a surprisingly high amplitude output signal, usually three to four times the amplitude obtainable with previously known pickups, particularly guitar pickups. In part because there is an external ferromagnetic shield around pickup 130 that is a part of its magnetic circuit, the pickup exhibits an excellent signal-to-noise ratio. Some hum from external sixty Hertz fields and the like may be present, but it is low enough so that the output signal from coil 143 is not unduly distorted.

All of the materials employed in pickup 130 are readily commercially available. Coil 143 is usually wound to a predetermined specification, and the dimensions of the core/shell members 141A and 141B must be established to fit the coil. Typically, the two halves 141A and 141B of shell/core 140, in a guitar pickup, may have a length L of about 2.25 inches (5.7 cm), a height of 0.6 inch (1.5 cm) and a thickness in a range of 0.02–0.05 inch (0.05–0.13 cm). Typically, permanent magnet 144 is about 0.03 inch (0.075 cm) thick, a commercially available product.

FIG. 7 illustrates another electromagnetic musical pickup 230 constructed in accordance with the invention, in a view similar to FIG. 4. FIGS. 5 and 6 would be essentially similar for pikcup 230. Pickup 230, FIG. 7, includes a combination shell and core 240 that comprises two elongated U-shaped steel members 241A and 241B. A coil form 242 is mounted on the central vertical (core) legs of members 241A and 241B. There is an electrical pickup coil 243, in a nonmagnetic coil form 242, encompassing the central vertical legs of the core. The permanent magnet 244 in pickup 230, as seen in FIG. 7, is again magnetized transversely in three longitudinal segments 245A, 245B and 245C so that the surfaces of the permanent magnet facing the outer vertical (shell) legs of core/shell members 241A and 241B of the pickup each present a continuous north pole. The polarization of the central longitudinal segment 245C of permanent magnet 244 is opposite to segments 245A and 245B so that the central vertical (core) portions of members 241A and 241B each face a south pole. As before, the polarizations of the segments 245A–245C of permanent magnet 244 may be reversed without affecting the basic operation.

In pickup 230, FIG. 7, all of the operational components of the pickup are again enclosed within a plastic pickup housing 231 and its base 232. Thus, pickup 230 is basically similar to pickup 130 (FIGS. 4–6); the materials employed may be as previously described, and operation is essentially similar. There is a difference, however. The upper ends 251A of the vertical legs of U-shaped core/shell member 241A are bent over onto the top of coil form 242 at the left-hand side of pickup 230 as seen in FIG. 7. Similarly, the upper ends 251B of the vertical legs of member 241B are bent over the right-hand side of the coil form. As a consequence, coil form 242 and coil 243 are mechanically anchored in place and the height of pickup 230 is reduced somewhat as compared to pickup 130. Moreover, there is likely to be some limited increase in output amplitude, and the frequency response of pickup 230, sensing movements of strings 234, may be modified to some extent as compared with pickup 130.

FIG. 8 is a transverse cross-section view of another electromagnetic musical pickup 330, similar to FIGS. 6 and 7. Pickup 330 includes a combination shell and core 340 that comprises two U-shaped steel members 341A and 341B. A coil form 342 is mounted on and encompasses the central vertical (core) legs of members 341A and 341B. An electrical pickup coil 343 is mounted in coil form 342. The permanent magnet 344 in pickup 330, shown in the bottom view of FIG. 9, and in section in FIG. 8, is magnetized transversely, but in a different pattern than in the previously described embodiments. Thus, the major area 346 of permanent magnet 344 is magnetized transversely to present a downwardly facing continuous north pole. In the central longitudinal part of permanent magnet 344, however, there are six separate areas 347, one for each musical string, that are transversely magnetized in the opposite direction. Thus, each area 347 affords a downwardly facing south pole. Permanent magnet 344 may be one integral strip of a magnet/resin material, with individual areas 347 differentiated from the major area 346 in the magnetization procedure, or areas 347 may be physically separate inserts in the permanent magnet, and may even be a different permanently magnetizable material, usually a material having a higher energy product.

Referring back to FIGS. 4–7, it should be noted that in those embodiments the integral permanent magnets 144 and 244 can be replaced with plural strips to afford individual magnets 145A–145C and 245A–245C if desired. Further, the pickups 130 and 230, FIGS. 4–7, can each be modified to utilize a permanent magnet like that of FIG. 9 if desired. Moreover, a reversal of the polarization shown in FIG. 9, which can be accomplished merely by turning permanent magnet 344 over, does not change the basic pickup operation.

Housing 331, FIG. 8, also differs from the housings 131 and 231 of previously described embodiments in that it affords an external recess 361 in which permanent magnet 344 is mounted. Thus, the permanent magnet 344 is outside of housing 331, not in it. The housing base 332 is the same. Again, this housing 331 can also be employed in the pickups of FIGS. 4 and 7. Of course, core/shell members 341A and 341B can be bent over in the manner shown in FIG. 7 to reduce the overall pickup height. As before, the electrical output signal from coil 343 represents the movements of the strings (e.g. string 334) with which pickup 330 is aligned (FIG. 8).

FIG. 10 illustrates, in transverse cross-section, a preliminary stage in assembly of a dual-coil electromagnetic pickup 430 for a musical instrument; pickup 430 constitutes another embodiment of the invention. At the preliminary stage illustrated in FIG. 10, pickup 430 is shown to include a U-shaped core 440 formed of steel or like ferromagnetic material; as in previous embodiments, No. 1008 steel having a thickness of about 0.02 to 0.05 inch (0.05 to 0.13 cm) is satisfactory. Core 440 has two vertically extending core members or legs 441A and 441B on which two non-magnetic coil forms 442A and 442B, usually plastic, are mounted. A first electrical pickup coil 443A is mounted in the form 442A; a second electrical pickup coil 443B is disposed in coil form 442B. A permanent magnet 436 is mounted on the bottom portion of core member 440 and projects upwardly between coils 443A and 443B at the center of the preliminary assembly. Permanent magnet 436, which may be formed of the same kinds of resin matrix materials as previously described, is transversely magnetized, presenting a continuous north pole surface facing coil 443B and a continuous south pole surface facing coil 443A.

Figure 11:
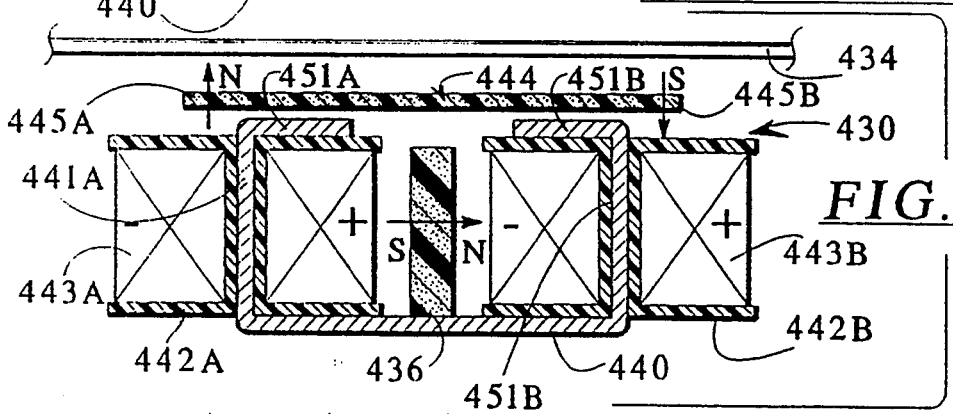
FIG. 11 is a transverse sectional view of the pickup of FIG. 10 in assembled condition, but omitting a housing.
Figure 12:
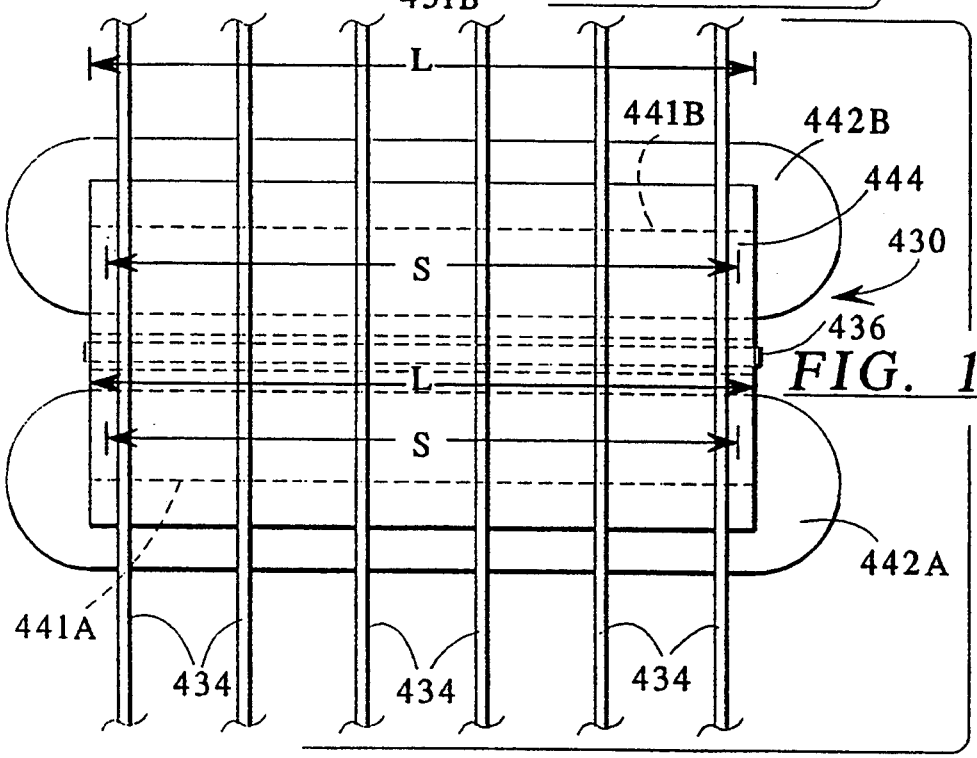
FIG. 12 is a plan view of the assembled pickup of FIG. 11, but with the outer housing again omitted.

The preliminary assembly shown in FIG. 10 may be subsequently completed in the form shown for pickup 430 in FIG. 11. The upper ends 451A and 451B of vertical legs 441A and 441B of the U-shaped core member 440 are bent over coil forms 442A and 442B, respectively. Thus, a part 451A of core 441A overlies coil 443A and a part 451B of core 441B projects over coil 443B. A main permanent magnet 444 is added to the assembly, as shown in FIG. 11, immediately above the bent over portions of core legs 441A and 441B. Indeed, magnet 444 may contact the upper parts 451A, 451B of core 440. The left-hand portion 445A of permanent magnet 444 is magnetized to present a continuous south pole surface facing toward core portion 451A and coil 443A. The right-hand side 445B of permanent magnet 444 is magnetized in the opposite direction and presents a continuous north pole surface facing toward core 451B and coil 443B. The central longitudinal portion of permanent magnet 444 need not be magnetized; indeed, it can be omitted, with two spaced permanent magnets employed. Permanent magnet 444 is located immediately below but spaced from the strings 434 of the musical instrument in which pickup 430 is utilized. This relationship is best illustrated in FIG. 12, which shows that the effective length L of pickup 430 is slightly larger than the overall string span S.

With coils 443A and 443B of pickup 430 connected to each other as in a conventional humbucker pickup, the signal-to-noise ratio of pickup 430 is quite high; moreover, there is virtually no hum in the output signal from the pickup. The desired signal output from device 430, produced by vibration of the ferromagnetic strings 434 in the magnetic field of the pickup, is appreciably higher in amplitude than with conventional humbucker pickups. Indeed, an increase in amplitude of three to four times may well be realized. The permanent magnet 436 protects pickup 430 against virbrational feedback and microphonic effects.

Figure 13:
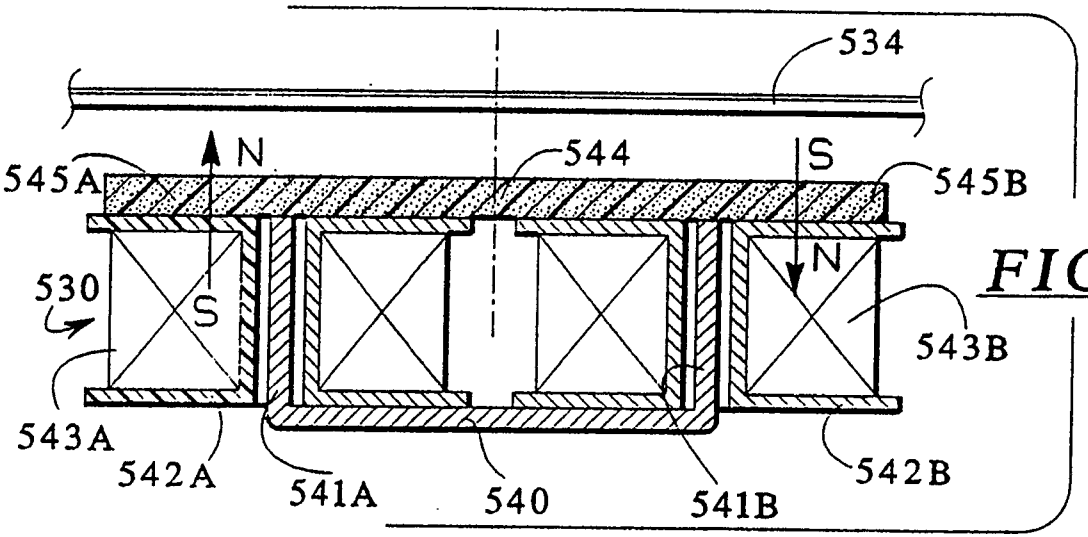
FIGS. 13 and 14 are transverse sectional views of further dual coil embodiments of the invention.

Yet another electromagnetic musical pickup 530, constructed in accordance with a further embodiment of the invention, is shown in FIG. 13, again in a transverse section view comparable to FIGS. 4, 7, 8 and 11. In pickup 530, which again is a dual-coil humbucker pickup, there is a U-shaped ferromagnetic core 540 having two vertical legs 541A and 541B encompassed by two non-magnetic coil forms or bobbins 542A and 542B, respectively; one electrical pickup coil 543A is mounted in the bobbin at the left-hand side of the pickup and another like coil 543B is in the coil form 542B at the right-hand side of the pickup, as seen in FIG. 13. The entire pickup 530 may be disposed within a suitable housing (not shown) of plastic or other suitable material.

A permanent magnet 544 is mounted on top of the other components of pickup 540, preferably in contact with the upper edges of core legs 541A and 541B, but below and spaced from the strings 534 of the instrument. The right-hand portion 545B of permanent magnet 544 is magnetized transversely to present a continuous north pole face to its associated core 541B and coil 543B, whereas the left-hand portion 545A of permanent magnet 544 presents a continuous south pole face immediately adjacent its associated coil 543A and core leg 541A. As before, reversal of all polarities can be effected, as by turning magnet 544 over longitudinally, without change in basic pickup performance. The central longitudinal portion of permanent magnet strip 544 need not be magnetized and can be physically omitted; see FIG. 14.

Like the previously described dual coil humbucker pickup 430 of FIGS. 10–12, humbucker pickup 530 of FIG. 13 generates a high amplitude output signal from its interconnected coils 543A and 543B. If those two coils are in the usual humbucker configuration, as shown, they cancel extraneous hum or noise; the output signal developed in response to vibration of any of the ferromagnetic strings 534 is of substantial amplitude but has little or no hum content. The signal-to-noise ratio is excellent.

Figure 14:
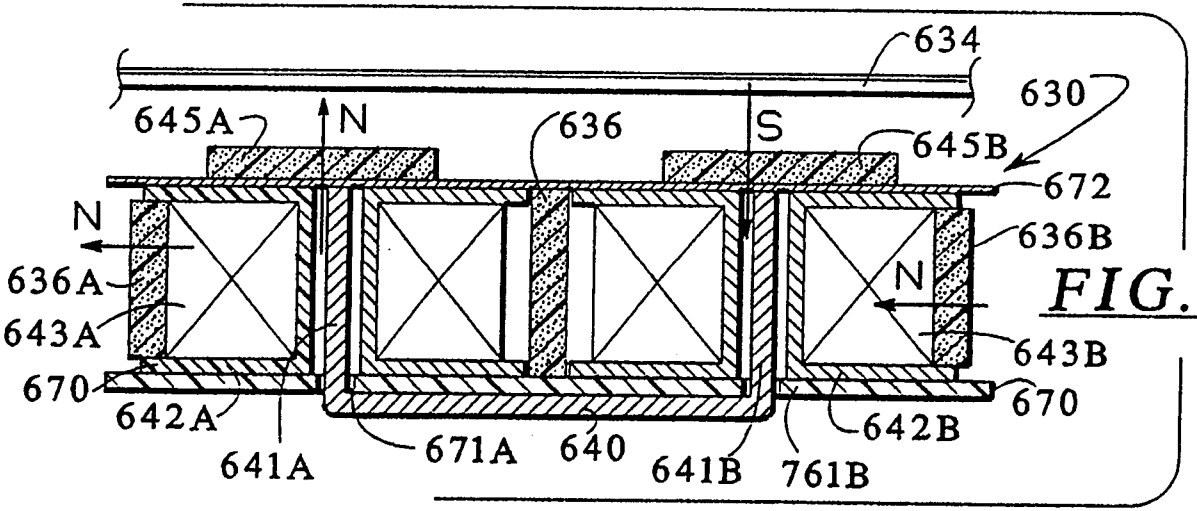

FIG. 14 affords a transverse sectional view of an electromagnetic pickup 630 for an electrical musical instrument, constructed in accordance with a further embodiment of the invention. Pickup 630 includes a printed circuit board 670 that is shown in plan, on a reduced scale, in FIG. 15. Referring primarily to FIG. 14, it is seen that pickup 630 includes a U-shaped central core 640 having two vertical legs 641A and 641B at the left and right-hand sides of the pickup. Core 640 is again made of ferromagnetic material; No. 1008 steel is acceptable. The vertical legs 641A and 641B of core 640 project through two elongated openings 671A and 671B in the printed circuit board 670. PC board 670 is described more fully hereinafter in connection with FIG. 15.

Electromagnetic pickup 630, FIG. 14, further comprises two electrical coils 643A and 643B mounted in two non-magnetic coil forms 642A and 642B, respectively. Coil form 642A is disposed in encompassing relation to the vertical core portion 641A of core 640 at the left-hand side of pickup 630 as seen in FIG. 14. Similarly, coil form 642B and its coil 643B encompass the other vertical core member 641B at the right-hand side of the pickup. There is a thin, electrically conductive foil 672 that extends across the top of pickup 630; typically, foil 672 may comprise a polyester film coated with a conductive metal such as aluminum. Above foil 672 there are two main permanent magnets 645A and 645B that are located immediately above the two ferromagnetic vertical core members 641A and 641B respectively. Permanent magnet 645A is transversely magnetized so that it presents a continuous south pole surface facing toward its associated core member 641A and coil 643A. Permanent magnet 645B is transversely magnetized, but in the opposite direction, so that it presents a continuous north pole surface facing toward its pole piece or core member 641B and its coil 643B.

A supplemental magnet 636 is included in pickup 630 between coils 643A and 643B. Magnet 636 is a shield magnet and is magnetized transversely so that its surface facing coil 643A constitutes a continuous south pole and its surface facing coil 643B is a continuous north pole. It will be recognized that this corresponds to the auxiliary permanent magnet 436 in the embodiment of FIGS. 10–12. There are two additional shield magnets 636A and 636B at the right and left-hand sides of pickup 630, as seen in FIG. 14, magnetized transversely as indicated to match the indicated polarizations of main magnets 645A and 645B, respectively. Two additional shield magnets 636A and 636B may be used in pickup 630. Shield magnet 636A is magnetized transversely to present a continuous south pole facing coil 643A, whereas shield magnet 636B is magnetized to present a continuous north pole facing coil 643B. As in other embodiments, all of the premanent magnet polarities may be reversed.

Figure 15:
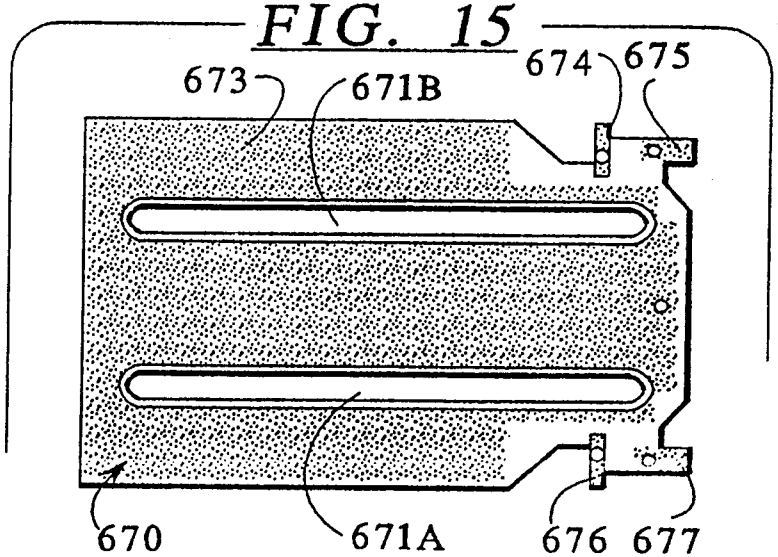
FIG. 15 is a plan view of a printed circuit board for the pickup of FIG. 14, also usable in other embodiments.

PC board 670, as shown in FIG. 15, has much of its surface covered by an electrically conductive film 673, usually a conductive copper film. In addition, there are four small conductive pads 674, 675, 676 and 677 on the printed circuit board. Pads 674–677 are utilized to make electrical connections for coils 643A and 643B (FIG. 14), whereas the larger conductive coating 673 affords a means for grounding pickup 630. Foil 672, at the top of pickup 630, is electrically connected to the ground coating 673 on the printed circuit board; the electrical ground connection for the foil is not illustrated.

Pickup 630, FIG. 14, like those described previously, is located immediately below and closely adjacent to the strings 634 of the musical instrument in which the pickup is utilized. Movement of any of the strings 634 induces signals in coils 643A and 643B because each of the strings intercepts the magnetic field of pickup 630, provided by the main permanent magnets 645A and 645B. The other permanent magnets 636, 636A, and 636B, contribute little to the active magnetic pickup field; they function primarily as shields for coils 643A and 643B. Like previously described embodiments of the invention, pickup 630 affords a high amplitude signal output. In a humbucker alignment for coils 643A and 643B, as shown the signal-to-noise ratio is excellent and virtually no hum is present in the output signal from the coils. Shield magnets 636, 636A and 636B may be omitted, but they are useful in reducing or eliminating vibrational feedback or microphone effects. It will be recognized that outside shield magnets like magnets 636A and 636B may also be used in other embodiments of the invention.

Figure 16:
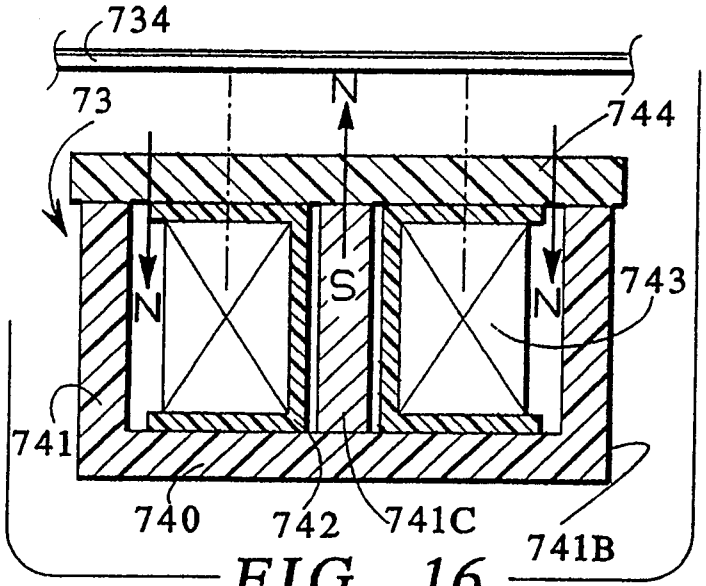
FIG. 16 is a transverse sectional view of another single-coil embodiment of the invention.

FIG. 16 affords a transverse sectional view of still another embodiment of the invention; it is basically similar in construction to the embodiments described above in connection with FIGS. 4–9. In this instance, however, the shell and core for the pickup 730 are provided by a powdered iron shell/core 740 having a shape like the letter E turned 90° and affording two vertical shell members 741A and 741B equally spaced from a central vertical core 741C. This core 741C encompassed by a non-magnetic coil form 742 within which an electrical pickup coil 743 is mounted.

The operating components for pickup 730 further comprise a main permanent magnet 744 that may have the same construction as described above for permanent magnet 144 of FIGS. 4–6 or that of permanent magnet 344 of pickup 330, FIGS. 8 and 9. Thus, the upper end of the ferromagnetic outer shell member 741A faces a permanent, continuous north pole, as does the upper end of shell element 741B of core 740. In contrast, the center core member 741C of the shell/core 740 faces a continuous permanent south pole at the permanent magnet 744. It will be apparent that pickup 730 functions in essentially the same manner as previously described embodiments of the invention, particularly the pickups 130 and 330 of FIGS. 4–6, 8 and 9, generating an electrical output signal representative of movements of strings 734, so that no further description is necessary. As in other embodiments, polarities of the permanent magnets may all be reversed without degrading pickup performance, and the permanent magnet segments can be physically separate instead of integral, as shown.

FIG. 17 affords a generalized illustration of a core or core/shell construction 840 that may be utilized in any of the previously described embodiments of the invention. The location of the core is shown in its orientation with respect to the strings 834 of the guitar or other musical instrument with which the pickup is employed. The core or shell 840 includes a plurality of vertical projections 848 that are each aligned with one of the musical strings 834. Projections 848 are separated by open spaces 849. This construction, when employed, modifies the tone quality of the electrical pickup but does not appreciably alter the amplitude characteristics, whether used in a single-coil or dual-coil pickup.

For all embodiments of the invention the parameters of individual components discussed above, particularly in connection with FIGS. 4–6, can be employed. The high energy product permanent magnet materials identified above, when used in the magnetic circuits of the pickups, enhance and improve output amplitude and may also be used to modify other characteristics of the pickups. As will be apparent from the foregoing description, any single-coil construction described can be incorporated in a dual-coil pickup, and vice-versa. The thickness of the ferromagnetic cores and shells may be selected to suit needs to emphasize (or de-emphasize) bass content in the frequency response of the pickup.

I claim:

1. An electromagnetic pickup for a musical instrument, such as a guitar, having a plurality of ferromagnetic strings disposed in co-planar spaced relation to each other and extending parallel to each other in a given plane over a predetermined span S, the pickup being adapted to be mounted adjacent the strings in spaced relation thereto, the pickup comprising:

an elongated ferromagnetic core having a length L larger than S and a smaller height, the core extending transversely to the direction of the strings;

the ferromagnetic core including a base and first and second legs interconnected by the base, the first and second legs projecting in the same direction from the base;

an electrical pickup coil disposed in encompassing relation to the first leg of the core;

main permanent magnet means including first and second thin, flat, elongated permanent magnets, the first permanent magnet being aligned with an edge of the first leg of the core and the second permanent magnet being aligned with an edge of the second leg of the core;

the first and second permanent magnets each being transversely magnetized to present a permanent magnet pole facing the associated leg of the core, the first and second permanent magnets being polarized oppositely from each other;

and mounting means for mounting the core and the permanent magnet means on the musical instrument with the legs of the core projecting toward but spaced from the strings.

2. An electromagnetic pickup for a plural ferromagnetic string musical instrument, according to claim 1, in which:

the ferromagnetic core has a double U-shaped cross-sectional configuration with the first leg in the center of the core and with two second legs at the outer edges of the core; and the main permanent magnet means includes two second permanent magnets, each aligned with an edge of one of the second legs of the core.

3. An electromagnetic pickup for a plural ferromagnetic string musical instrument, according to claim 2, in which:

the ferromagnetic core is formed of two U-shaped ferromagnetic channels joined together to form a core of double U-shaped cross section; and the electrical pickup coil encompasses two adjoining legs of the core channels at the center of the pickup.

4. An electromagnetic pickup for a plural ferromagnetic string musical instrument, according to claim 3, in which:

the two channels forming the core are each formed of sheet steel; and the edges of the core legs closest to the strings are bent over a part of the electrical pickup coil.

5. An electromagnetic pickup for a plural ferromagnetic string musical instrument, according to claim 2, in which:

the mounting means comprises a plastic housing enclosing the core, the coil, and the permanent magnets.

6. An electromagnetic pickup for a plural ferromagnetic string musical instrument, according to claim 2, in which:

the mounting means comprises a plastic housing enclosing the core and the coil; and the first and second permanent magnets are mounted on the exterior of the housing.

7. An electromagnetic pickup for a plural ferromagnetic string musical instrument, according to claim 2, in which:

the core is formed of compressed powdered iron.

8. An electromagnetic pickup for a plural ferromagnetic string musical instrument, according to claim 1, in which:

a second electrical pickup coil is disposed in encompassing relation to the second leg of the core.

9. An electromagnetic pickup for a plural ferromagnetic string musical instrument, according to claim 8, in which:

an elongated, thin, flat shield magnet is interposed between the electrical pickup coils, the shield magnet being transversely magnetized to present a surface facing each coil that has the same polarity as the polarity of the main permanent magnet facing the core encompassed by that coil.

10. An electromagnetic pickup for a plural ferromagnetic string musical instrument, according to claim 8, and further comprising:

two second elongated, thin, flat outer shield magnets, each mounted along the outer side of one of the electrical pickup coils, each outer shield magnet being transversely magnetized to present a surface facing its associated coil that has the same polarity as the polarity of the main permanent magnet facing the core leg encompassed by that coil.

11. An electromagnetic pickup for a plural ferromagnetic string musical instrument, according to claim 10, in which:

an elongated, thin, flat central shield magnet is interposed between the electrical pickup coils, the central shield magnet being transversely magnetized to present a surface facing each coil that has the same polarity as the polarity of the main permanent magnet facing the core encompassed by that coil.

12. An electromagnetic pickup for a plural ferromagnetic string musical instrument, according to claim 1, in which the first and second permanent magnets comprise one integral strip of permanent magnet material and are differentiated from each other only in that their directions of magnetization are opposite.

13. An electromagnetic pickup for a plural ferromagnetic string musical instrument, according to claim 12, in which the first permanent magnet comprises a series of limited areas differentiated in that their direction of magnetization is opposed to the second permanent magnet, which second permanent magnet comprises the remainder of the integral strip.

14. An electromagnetic pickup for a plural ferromagnetic string musical instrument, according to claim 2, in which the first permanent magnet and both of the second permanent magnets comprise one integral strip of permanent magnet material and are differentiated from each other only in that their directions of magnetization are opposite.

15. An electromagnetic pickup for a plural ferromagnetic string musical instrument, according to claim 1, in which the first and second permanent magnets comprise physically separate elongated strips of permanent magnet material.

16. An electromagnetic pickup for a plural ferromagnetic string musical instrument, according to claim 2, in which the first permanent magnet and both of the second permanent magnets comprise physically separate elongated strips of permanent magnet material.

17. An electromagnetic pickup for a plural ferromagnetic string musical instrument, according to claim 2, in which the first permanent magnet comprises a first strip of high energy product permanent magnet material, magnetized in one direction and physically disposed in the center of an elongated second strip of lower energy product permanent magnet material magnetized in the opposite direction, which second strip comprises both of the second permanent magnets.

18. An electromagnetic pickup for a plural ferromagnetic string musical instrument, according to claim 17, in which the strip of high energy product permanent magnet material comprising the first permanent magnet is formed as a series of inserts in the second permanent magnet strip.

19. An electromagnetic pickup for a plural ferromagnetic string musical instrument, according to claim 1, and further comprising:

a thin, electrically conductive non-magnetic film interposed between the permanent magnets and the core;

and means for grounding the film.

20. An electromagnetic pickup for a plural ferromagnetic string musical instrument, according to claim 19, in which:

the means for grounding the film is a printed circuit having a main conductive coating electrically connected to the film.

21. An electromagnetic pickup for a plural ferromagnetic string musical instrument, according to claim 20, in which the printed circuit has at least two additional electrically conductive coatings, electrically separate from the main coating, that are electrically connected to the pickup coil.

22. An electromagnetic pickup for a plural ferromagnetic string musical instrument, according to claim 8, and further comprising:

a thin, electrically conductive non-magnetic film interposed between the permanent magnets and the core;

and means for grounding the film.

23. An electromagnetic pickup for a plural ferromagnetic string musical instrument, according to claim 22, in which:

the means for grounding the film is a printed circuit having a main conductive coating electrically connected to the film.

24. An electromagnetic pickup for a plural ferromagnetic string musical instrument, according to claim 23 in which:

the printed circuit has at least three additional electrically conductive coatings, electrically separate from the main coating, that are electrically connected to the pickup coils.

25. An electromagnetic pickup for a plural ferromagnetic string musical instrument, according to claim 1, in which the electrical pickup coil is formed of 43 gauge or larger copper wire.

26. An electromagnetic pickup for a plural ferromagnetic string musical instrument, according to claim 8, in which each electrical pickup coil is formed of 43 gauge or larger copper wire.

* * * * *